US011085249B2

(12) United States Patent
Selvam

(10) Patent No.: US 11,085,249 B2
(45) Date of Patent: Aug. 10, 2021

(54) SWIVEL ASSEMBLY FOR DRILLING MACHINE

(71) Applicant: Caterpillar Global Mining Equipment LLC, Denison, TX (US)

(72) Inventor: Sudhagar Selvam, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 16/706,469

(22) Filed: Dec. 6, 2019

(65) Prior Publication Data

US 2021/0172267 A1 Jun. 10, 2021

(51) Int. Cl.
*E21B 19/08* (2006.01)
*E21B 7/02* (2006.01)

(52) U.S. Cl.
CPC ..... *E21B 19/08* (2013.01); *E21B 7/022* (2013.01); *E21B 7/025* (2013.01)

(58) Field of Classification Search
CPC ..... E21B 19/08; E21B 7/022; E21B 7/025
See application file for complete search history.

(56) References Cited

U.S. PATENT DOCUMENTS

| | | | | |
|---|---|---|---|---|
| 3,823,902 | A * | 7/1974 | Bumueller | B62D 53/02 248/647 |
| 4,049,065 | A * | 9/1977 | Walter | E21B 3/02 175/52 |
| 4,364,540 | A | 12/1982 | Montabert | |
| 9,068,453 | B2 | 6/2015 | Rohwer et al. | |
| 10,100,592 | B2 | 10/2018 | Wase | |
| 2019/0178082 | A1 * | 6/2019 | Hanna | E21B 7/025 |

FOREIGN PATENT DOCUMENTS

| | | | | |
|---|---|---|---|---|
| CN | 107178314 | | 9/2017 | |
| CN | 107420034 | | 12/2017 | |
| CN | 207420600 | | 5/2018 | |
| DE | 2608278 | | 9/1977 | |
| GB | 191210901 | | 2/1913 | |
| GB | 2417478 | A * | 3/2006 | E02F 3/475 |

* cited by examiner

*Primary Examiner* — James G Sayre

(57) ABSTRACT

A swivel assembly for a drilling machine is provided. The swivel assembly includes a positioning member pivotally coupled to a boom member associated with the drilling machine. The swivel assembly also includes a bearing assembly coupled to each of the positioning member and a feed table associated with the drilling machine. The bearing assembly is adapted to rotate about a rotational axis. The swivel assembly further includes at least one actuator operably coupled to the bearing assembly. The bearing assembly is adapted to selectively rotate the feed table relative to the positioning member about the rotational axis based, at least in part, on an actuation of the at least one actuator.

20 Claims, 7 Drawing Sheets

SWIVEL ASSEMBLY FOR DRILLING MACHINE

TECHNICAL FIELD

The present disclosure relates to a swivel assembly for a drilling machine. More particularly, the present disclosure relates to the swivel assembly for a feed assembly associated with the drilling machine.

BACKGROUND

A drilling machine, such as a boom mounted drilling machine, includes a feed assembly rotatably coupled to a boom of the drilling machine. The feed assembly supports a drilling assembly of the drilling machine. During a drilling operation, the feed assembly is adapted to rotate relative to the boom in order to provide a desired tilt for the drilling assembly. In many situations, a linkage assembly is provided in association with the boom and the feed assembly in order to provide rotation of the feed assembly relative to the boom about a rotational axis.

The linkage assembly may include a number of interconnecting components, such as a number of arms, joints, actuators, and so on that may be adapted to move relative to one another. The interconnecting components may increase complexity, cost, and weight of the machine. In many situations, based on an overall configuration of the linkage assembly, rotation of the feed assembly relative to the boom may be asymmetric about the rotational axis. Also, a rotational speed of the feed assembly may not be uniform throughout a range of rotation of the feed assembly. Hence, there is a need for an improved swivel assembly for such applications.

Chinese Patent Number 107420034 describes a hydraulic drill arm with multiple degrees of freedom. The hydraulic drill arm comprises a base, a left-right swing mechanism, an up-down swing mechanism, a rotary mechanism and a sliding adjusting mechanism. The left-right swing mechanism is arranged on the base. The up-down swing mechanism is connected to the left-right swing mechanism. The sliding adjusting mechanism is connected to the up-down swing mechanism through the rotary mechanism. A side plate and a fixed rotary frame are also fixedly arranged on the base. The left-right swing mechanism is connected to the base through the side plate and the fixed rotary frame.

SUMMARY OF THE DISCLOSURE

In an aspect of the present disclosure, a swivel assembly for a drilling machine is provided. The swivel assembly includes a positioning member pivotally coupled to a boom member associated with the drilling machine. The swivel assembly also includes a bearing assembly coupled to each of the positioning member and a feed table associated with the drilling machine. The bearing assembly is adapted to rotate about a rotational axis. The swivel assembly further includes at least one actuator operably coupled to the bearing assembly. The bearing assembly is adapted to selectively rotate the feed table relative to the positioning member about the rotational axis based, at least in part, on an actuation of the at least one actuator.

In another aspect of the present disclosure, a feed assembly for a drilling machine is provided. The feed assembly includes a feed table adapted to receive a drill assembly. The feed assembly includes a positioning member pivotally coupled to a boom member associated with the drilling machine. The feed assembly also includes a bearing assembly coupled to each of the positioning member and the feed table. The bearing assembly is adapted to rotate about a rotational axis. The feed assembly further includes at least one actuator operably coupled to the bearing assembly. The bearing assembly is adapted to selectively rotate the feed table relative to the positioning member about the rotational axis based, at least in part, on an actuation of the at least one actuator.

In yet another aspect of the present disclosure, a drilling machine is provided. The drilling machine includes a chassis. The drilling machine includes a boom member movably coupled to the chassis. The drilling machine includes a positioning member pivotally coupled to the boom member. The drilling machine includes a feed table rotatably coupled to the positioning member. The drilling machine also includes a bearing assembly coupled to each of the positioning member and the feed table. The bearing assembly is adapted to rotate about a rotational axis. The drilling machine further includes at least one actuator operably coupled to the bearing assembly. The bearing assembly is adapted to selectively rotate the feed table relative to the positioning member about the rotational axis based, at least in part, on an actuation of the at least one actuator.

Other features and aspects of this disclosure will be apparent from the following description and the accompanying drawings.

DETAILED DESCRIPTION

Figure 1:
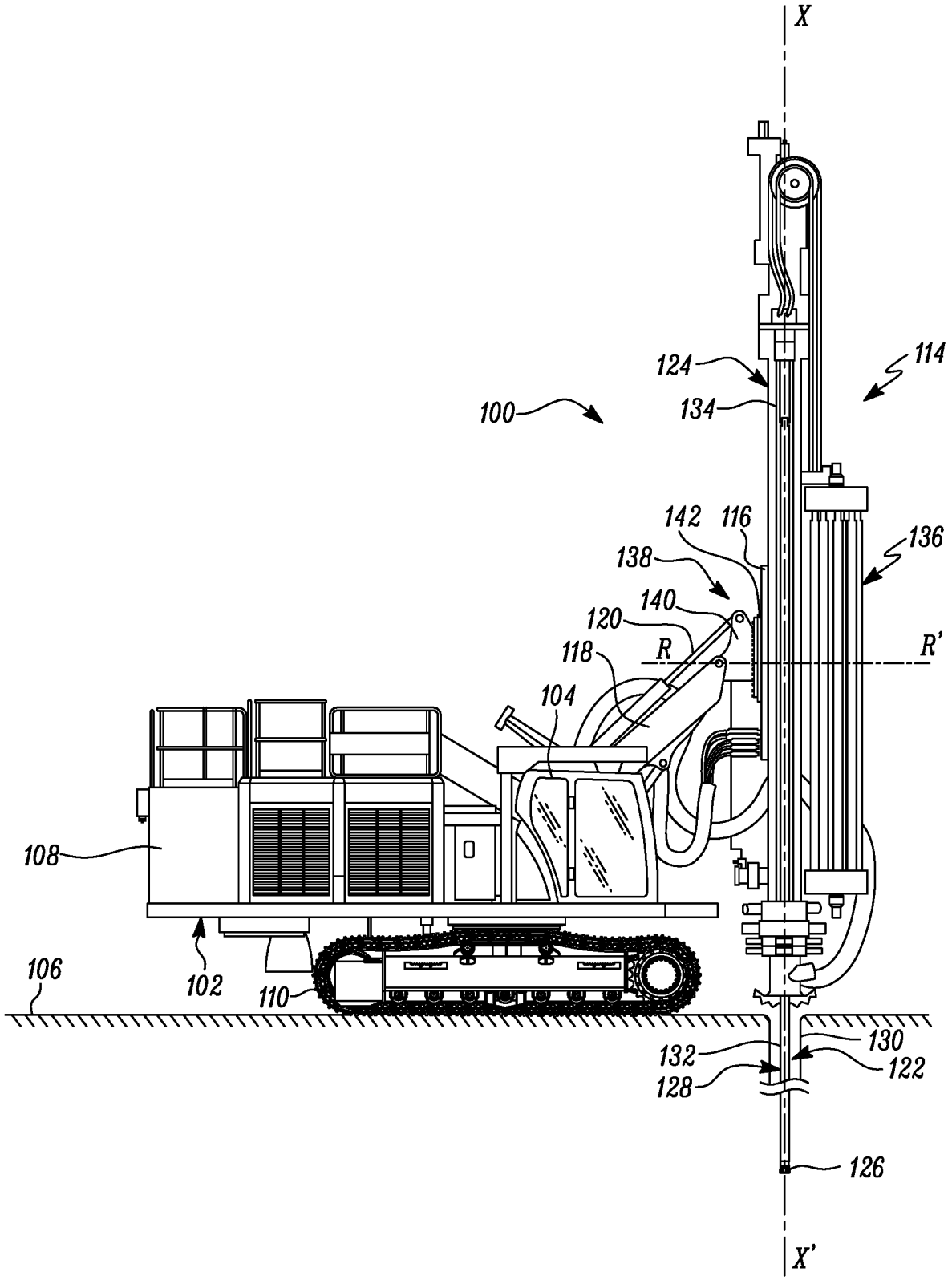
FIG. 1 is a side view of an exemplary drilling machine, according to one embodiment of the present disclosure.

Wherever possible, the same reference numbers will be used throughout the drawings to refer to the same or like parts. Referring to FIG. 1, a side view of an exemplary drilling machine 100 is illustrated. The drilling machine 100 will be hereinafter interchangeably referred to as the "machine 100". In the illustrated embodiment, the machine 100 is a boom mounted drilling machine. In other embodiments, the machine 100 may be any other drilling machine, such as a surface drilling machine, a rotary blasthole type drilling machine, and so on, based on application requirements. The machine 100 performs various drilling related operations, such as sub-surface mineral extraction; mineral exploration; environmental exploration; hydraulic fracturing; oil, gas, and/or water extraction wells; rock cut drilling for mining and/or quarrying operations; and so on, based on application requirements.

The machine 100 includes a chassis 102. The chassis 102 supports one or more components of the machine 100 thereon. The machine 100 also includes an operator cabin 104 mounted on the chassis 102. The operator cabin 104 may include one or more controls (not shown), such as one or more operator consoles, joysticks, pedals, levers, buttons, switches, steering, and so on. The controls are adapted to control an operation of the machine 100 on a work surface 106. It should be noted that, in many situations, the machine 100 may be an autonomous machine, a semi-autonomous machine, a remotely operated machine, a remotely supervised machine, and so on, based on application requirements.

The machine 100 also includes an enclosure 108 provided on the chassis 102. The enclosure 108 encloses a power source (not shown) mounted on the chassis 102. The power source provides power to the machine 100 for mobility and operational requirements. The power source may include, but not limited to, a diesel engine, a gasoline engine, a gaseous fuel powered engine, a dual fuel powered engine, an electric motor, a fuel cell, a battery, and/or a combination thereof, based on application requirements. Additionally, the machine 100 may include components and/or systems (not shown), such as a fuel delivery system, an air delivery system, a lubrication system, a propulsion system, a drivetrain, a drive control system, a machine control system, and so on, based on application requirements.

The machine 100 also includes a set of ground engaging members 110 (only one ground engaging member shown in the accompanying figure). The ground engaging members 110 are operably coupled to the chassis 102. In the illustrated embodiment, the ground engaging members 110 are tracks. In other embodiments, the ground engaging members 110 may be wheels. The ground engaging members 110 support and provide mobility to the machine 100 on the work surface 106. As such, the ground engaging members 110 provide movement, turning, positioning, and travel of the machine 100 on the work surface 106.

The machine 100 also includes a feed assembly 114. The feed assembly 114 includes a feed table 116 disposed on the chassis 102. The feed table 116 will be hereinafter interchangeably referred to as the "table 116". The table 116 is pivotally coupled to the chassis 102 using a boom member 118. The boom member 118 is movably coupled to the chassis 102 using a shift cylinder 120. As such, the table 116 is movable relative to the chassis 102 between a substantially vertical position (shown in the accompanying figure) and a non-vertical position (not shown) via the shift cylinder 120. Accordingly, the shift cylinder 120 provides alignment of the table 116 along a height and a width of the chassis 102. The table 116 is a linearly extending structure, and in the accompanying figure, is upright, extending along a vertical axis X-X'. The table 116 supports one or more drilling components of the machine 100.

The feed assembly 114 also includes a drill assembly 122. The drill assembly 122 is movably disposed on the table 116 via a mast 124. The drill assembly 122 is adapted for drilling holes, channels, tunnels, openings, and so on into, within, and/or extending into, and/or below, the work surface 106. Accordingly, the drill assembly 122 includes a drill bit 126 and a drill string 128 removably coupled to the drill bit 126. Accordingly, the drill assembly 122 is adapted to drill a borehole 130 into the work surface 106.

The drill string 128 includes one or more columns or pipes 132 interlinked with each other and with the drill bit 126. Each of the pipes 132 of the drill assembly 122 have a hollow and generally cylindrical configuration. The pipes 132 provide extension of the drill bit 126 into the borehole 130. For example, each pipe 132 may be coupled to another pipe 132 by way of a threaded connection (not shown). In other embodiments, the pipes 132 may be interlinked with each other by way of other similar connections, for example, by lock fittings, snap fittings, and so on, based on application requirements. The drill string 128 is slidably coupled with the table 116 via supporting rails 134 and may be driven by a motor (not shown) to slidably move relative to the table 116 on the supporting rails 134 along the vertical axis X-X'.

The feed assembly 114 also includes a carousel 136. The carousel 136 is disposed on the feed table 116 via the mast 124. The carousel 136 may store and support one or more pipes 132 of the drill assembly 122 when the drill assembly 122 or the drill string 128 is not in use. In one example, the carousel 136 includes a plurality of slots (not shown) adapted to hold the pipes 132. The carousel 136 may also be used to add pipes 132 to the drill assembly 122 to form the drill string 128 when in use. Additionally, the feed assembly 114 may include one or more components and systems (not shown), such as a drive mechanism including a motor, a chain, a sprocket, and so on; a rotary mechanism; actuators; adapters; guiding members; valves; sensors; controllers; and so on, based on application requirements.

The feed assembly 114 further includes a swivel assembly 138. The swivel assembly 138 includes a positioning member 140 and a bearing assembly 142. The positioning member 140 will be hereinafter interchangeably referred to as the "positioner 140". The positioner 140 is pivotally coupled to the boom member 118. The bearing assembly 142 will be hereinafter interchangeably referred to as the "bearing 142". The bearing 142 is adapted to rotate about a rotational axis R-R'. The bearing 142 is coupled to each of the positioner 140 and the table 116. Accordingly, the table 116 is rotatably coupled to the positioner 140 via the bearing 142.

Figure 2:
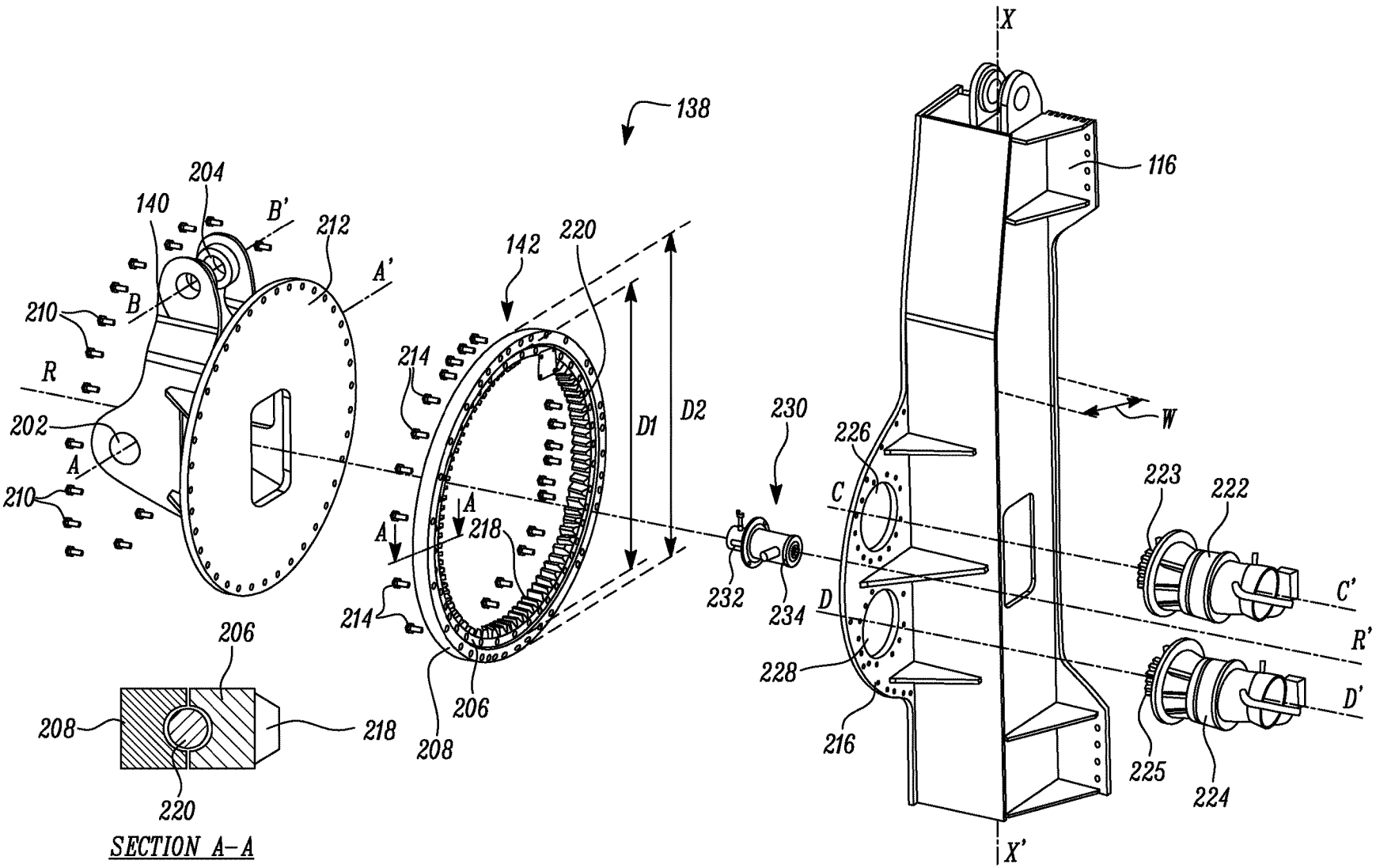
FIG. 2 is a perspective exploded view of a swivel assembly of the drilling machine, according to one embodiment of the present disclosure.
Figure 3:
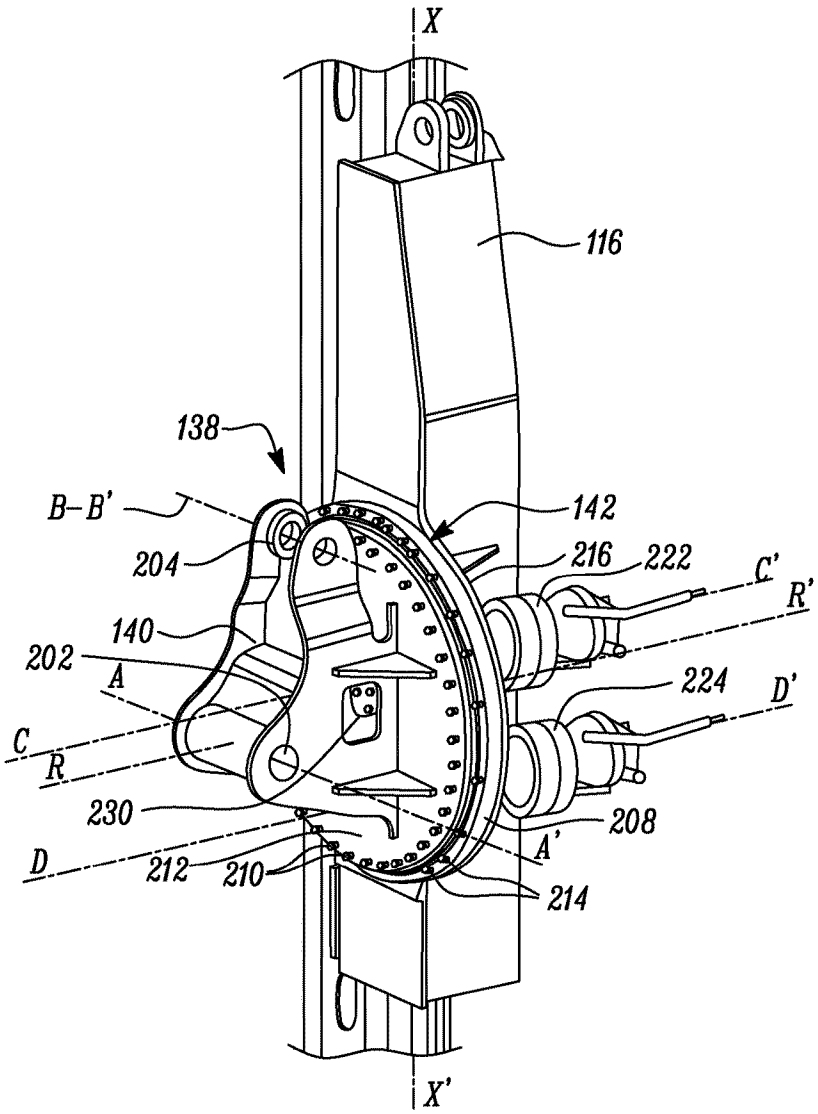
FIG. 3 is a perspective view of the swivel assembly assembled on a portion of the drilling machine, according to one embodiment of the present disclosure.

Referring to FIG. 2, a perspective exploded view of the swivel assembly 138 is illustrated. Referring to FIG. 3, a perspective assembled view of the swivel assembly 138 is illustrated. With combined reference to FIGS. 2 and 3, the positioner 140 is adapted to be pivotally coupled to the boom member 118 at a first hinge joint 202 defining a first joint axis A-A'. Accordingly, the positioner 140 is adapted to pivot relative to the boom member 118 about the first hinge joint 202 and the first joint axis A-A'. Further, the positioner 140 is adapted to be pivotally coupled to the shift cylinder 120 at a second hinge joint 204 defining a second joint axis B-B'. The second joint axis B-B' is disposed spaced apart relative to the first joint axis A-A'. Also, the second joint axis B-B' is disposed substantially parallel to the first joint axis A-A'. Accordingly, the positioner 140 is adapted to pivot relative to the shift cylinder 120 about the second hinge joint 204 and the second joint axis B-B'.

The bearing 142 includes a first ring member 206 and a second ring member 208. The first ring member 206 will be hereinafter interchangeably referred to as the "first ring 206". The second ring member 208 will be hereinafter interchangeably referred to as the "second ring 208". The first ring 206 is fixedly coupled to the positioner 140 using a number of first fasteners 210. More specifically, the first ring 206 is fixedly coupled to a first bearing base 212 provided on the positioner 140. The second ring 208 is fixedly coupled to the table 116 using a number of second fasteners 214. More specifically, the second ring 208 is fixedly coupled to a second bearing base 216 provided on the table 116.

In the illustrated embodiment, each of the first fasteners 210 and the second fasteners 214 is a screw type fastener. In other embodiments, one or more of the first fasteners 210 and the second fasteners 214 may be a nut and bolt type fastener, a rivet type fastener, and so on, based on application requirements. It should be noted that, in other embodiments, the first ring 206 may be interchangeably coupled to the table 116, and the second ring 208 may be interchangeably coupled to the positioner 140, based on application requirements.

The first ring 206 defines a diameter "D1", and the second ring 208 defines a diameter "D2". The diameter "D1" of the first ring 206 is smaller than the diameter "D2" of the second ring 208. Accordingly, the first ring 206 is disposed within the second ring 208. The bearing 142 also includes a ring gear 218 disposed within the first ring 206. The bearing 142 further includes at least one bearing element 220 disposed between the first ring member 206 and the second ring member 208. In the illustrated embodiment, the bearing element 220 is a ball type bearing element. In other embodiments, the bearing element 220 may be any other bearing element, such as an interconnecting surface type bearing, a sliding surface type bearing, a roller type bearing, a fluid type bearing, a magnetic type bearing, and so on, based on applications. As such, the bearing element 220 is adapted to rotate the second ring 208 relative to the first ring 206 about the rotational axis R-R'.

The swivel assembly 138 also includes at least one actuator. In the illustrated embodiment, the swivel assembly 138 includes a plurality of actuators, such as a first actuator 222 and a second actuator 224. The first actuator 222 defines a first actuator axis C-C', and the second actuator 224 defines a second actuator axis D-D'. Each of the first actuator axis C-C' and the second actuator axis D-D' is substantially parallel to one another and the rotational axis R-R'. In other embodiments, the swivel assembly 138 may include single or multiple actuators, based on application requirements. In the illustrated embodiment, each of the first actuator 222 and the second actuator 224 is disposed adjacent to one another. In other embodiments, each of the first actuator 222 and the second actuator 224 may be disposed substantially spaced apart from another. Also, each of the first actuator 222 and the second actuator 224 is coupled to the second bearing base 216 and disposed in each of the actuator recesses 226, 228, respectively.

The at least one actuator is operably coupled to the bearing assembly 142. More specifically, each of the first actuator 222 and the second actuator 224 includes a first pinion gear 223 and a second pinion gear 225, respectively. Accordingly, each of the first actuator 222 and the second actuator 224 is operably coupled to the ring gear 218 via the first pinion gear 223 and the second pinion gear 225, respectively. Based on an actuation of each of the first actuator 222 and the second actuator 224, each of the first actuator 222 and the second actuator 224 moves along the ring gear 218. The movement of each of the first actuator 222 and the second actuator 224 along the ring gear 218 rotates the second ring 208 of the bearing 142 relative to the first ring 206 of the bearing 142 about the rotational axis R-R'. Rotation of the second ring 208 relative to the first ring 206, in turn, rotates the table 116 relative to the positioner 140 about the rotational axis R-R'.

Figure 4:
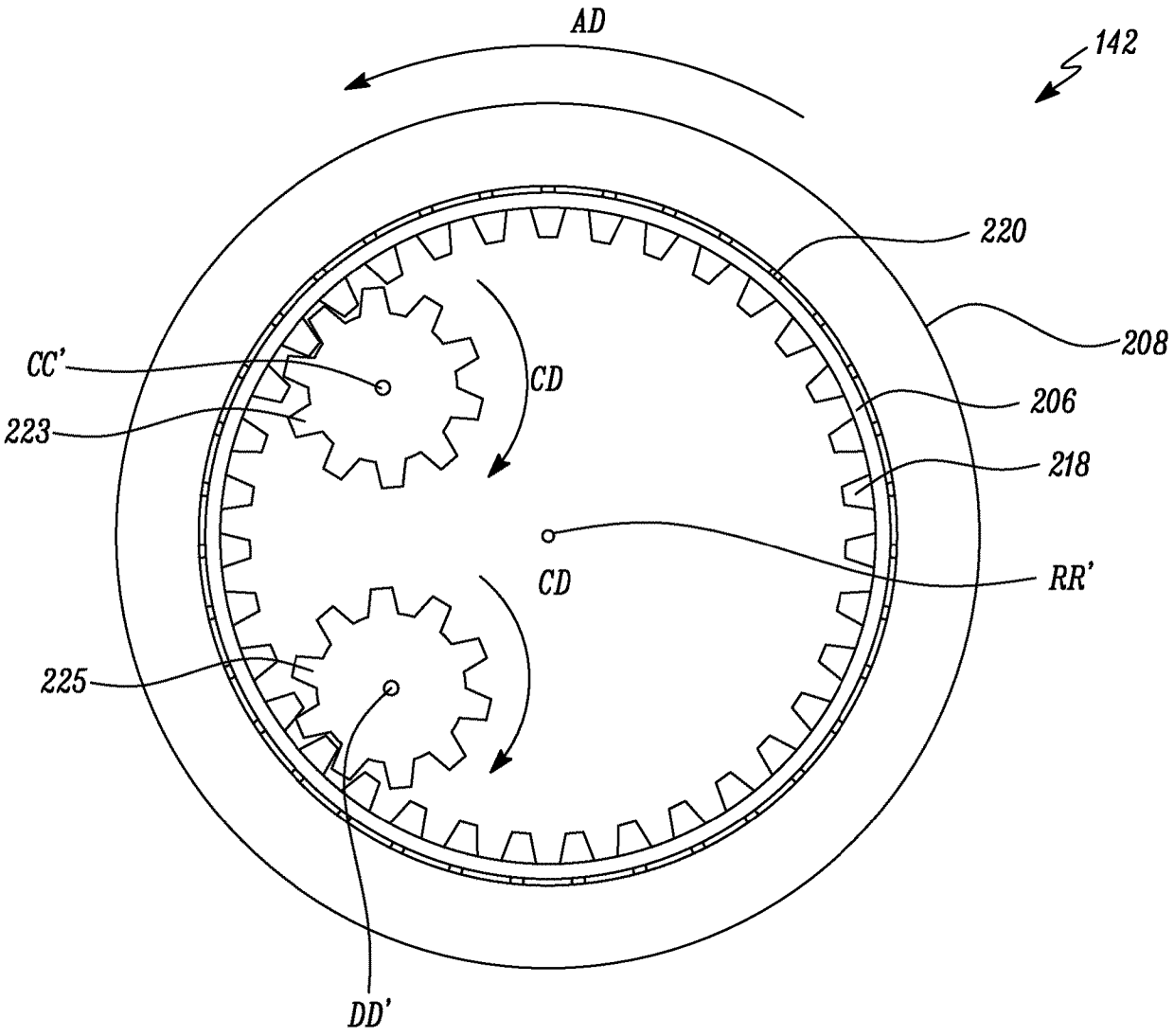
FIG. 4 is a schematic representation of a portion of the swivel assembly in an assembled position, according to one embodiment of the present disclosure.

For example, referring to FIG. 4, based on the actuation of each of the first actuator 222 and the second actuator 224, each of the first pinion gear 223 and the second pinion gear 225 rotates about the first actuator axis C-C' and the second actuator axis D-D', respectively, in a clockwise direction "CD". Further, during rotation, each of the first pinion gear 223 and the second pinion gear 225 revolves along the ring gear 218 about the rotational axis R-R' in an anticlockwise direction "AD". As each of the first actuator 222 and the second actuator 224 is fixedly coupled to the second ring 208 and the table 116 via the second bearing base 216, revolution of each of the first pinion gear 223 and the second pinion gear 225 results in rotation of the second ring 208 and the table 116 about the rotational axis R-R' in the anticlockwise direction "AD" relative to the positioner 140. In other embodiments, each of the first pinion gear 223 and the second pinion gear 225 may rotate in the anticlockwise direction "AD", such that the second ring 208 and the table 116 may rotate in the clockwise direction "CD". As such, rotation of each of the first pinion gear 223 and the second pinion gear 225 provides rotation of the second ring 208 and, thus, that of the table 116.

Accordingly, based on the actuation of each of the first actuator 222 and the second actuator 224, the bearing assembly 142 is adapted to selectively rotate the feed table 116 relative to the positioning member 140 about the rotational axis R-R'. In the illustrated embodiment, each of the first actuator 222 and the second actuator 224 is a hydraulic motor. In other embodiments, one or more of the first actuator 222 and the second actuator 224 may be any other actuator, such as an electric actuator, a magnetic actuator, and so on, based on application requirements.

The swivel assembly 138 further includes a swivel joint 230 (also commonly known as a rotary union). The swivel joint 230 includes a first portion 232 and a second portion 234. The second portion 234 is rotatably and fluidly coupled to the first portion 232. In an assembled position of the swivel assembly 138, the first portion 232 of the swivel joint 230 is removably coupled to the positioner 140, and the second portion 234 of the swivel joint 230 is removably coupled to the table 116. Accordingly, the swivel joint 230 provides a rotatable fluid joint within the swivel assembly 138. As such, the swivel joint 230 provides an intermediate connection for fluidly coupling one or more hydraulic systems (not shown) disposed on the feed assembly 114 with a hydraulic power source (not shown) disposed on the machine 100 or external to the machine 100.

Figure 5:
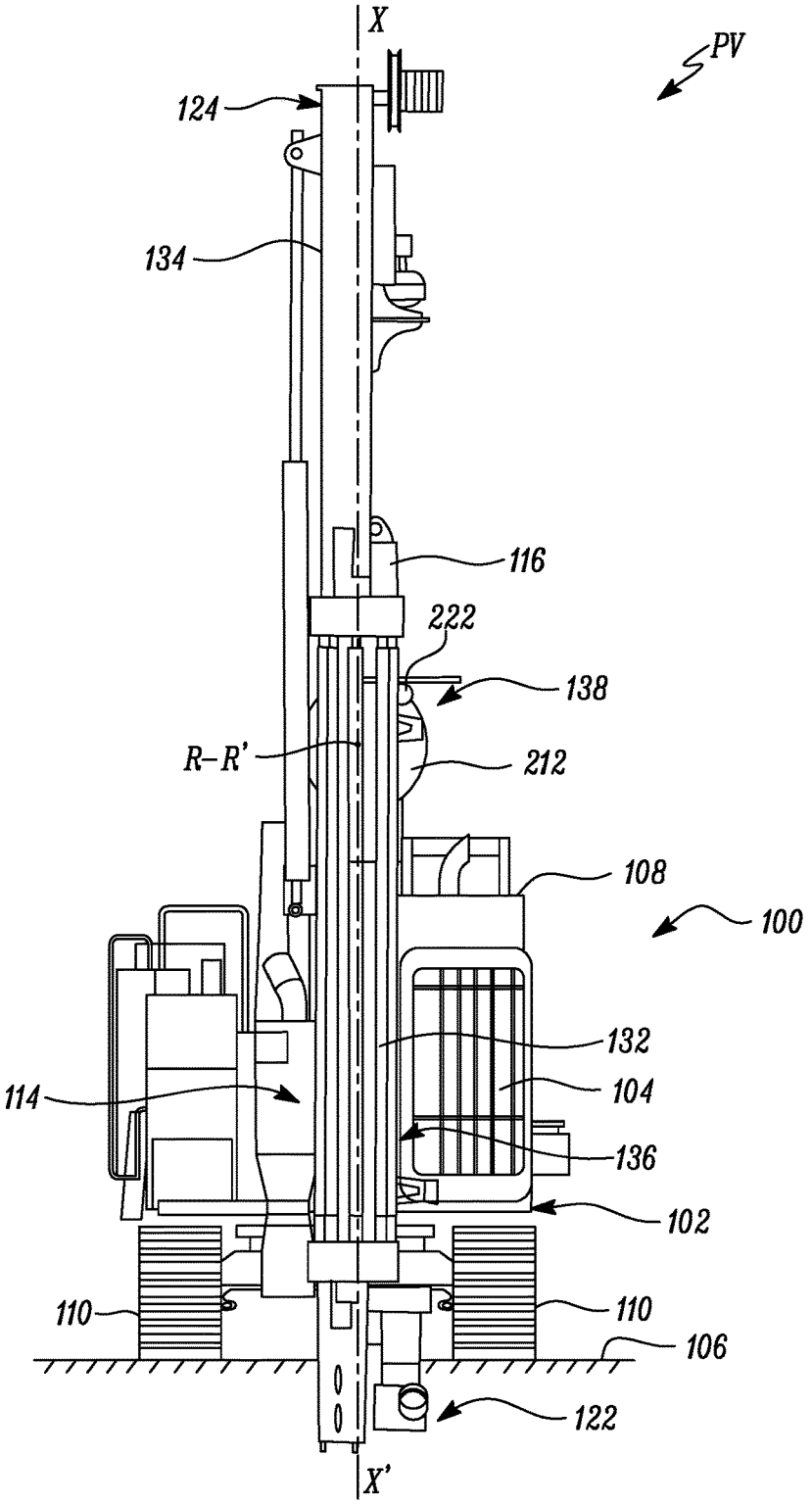
FIG. 5 is a front view of the machine showing an operating position of the swivel assembly, according to one embodiment of the present disclosure.
Figure 6:
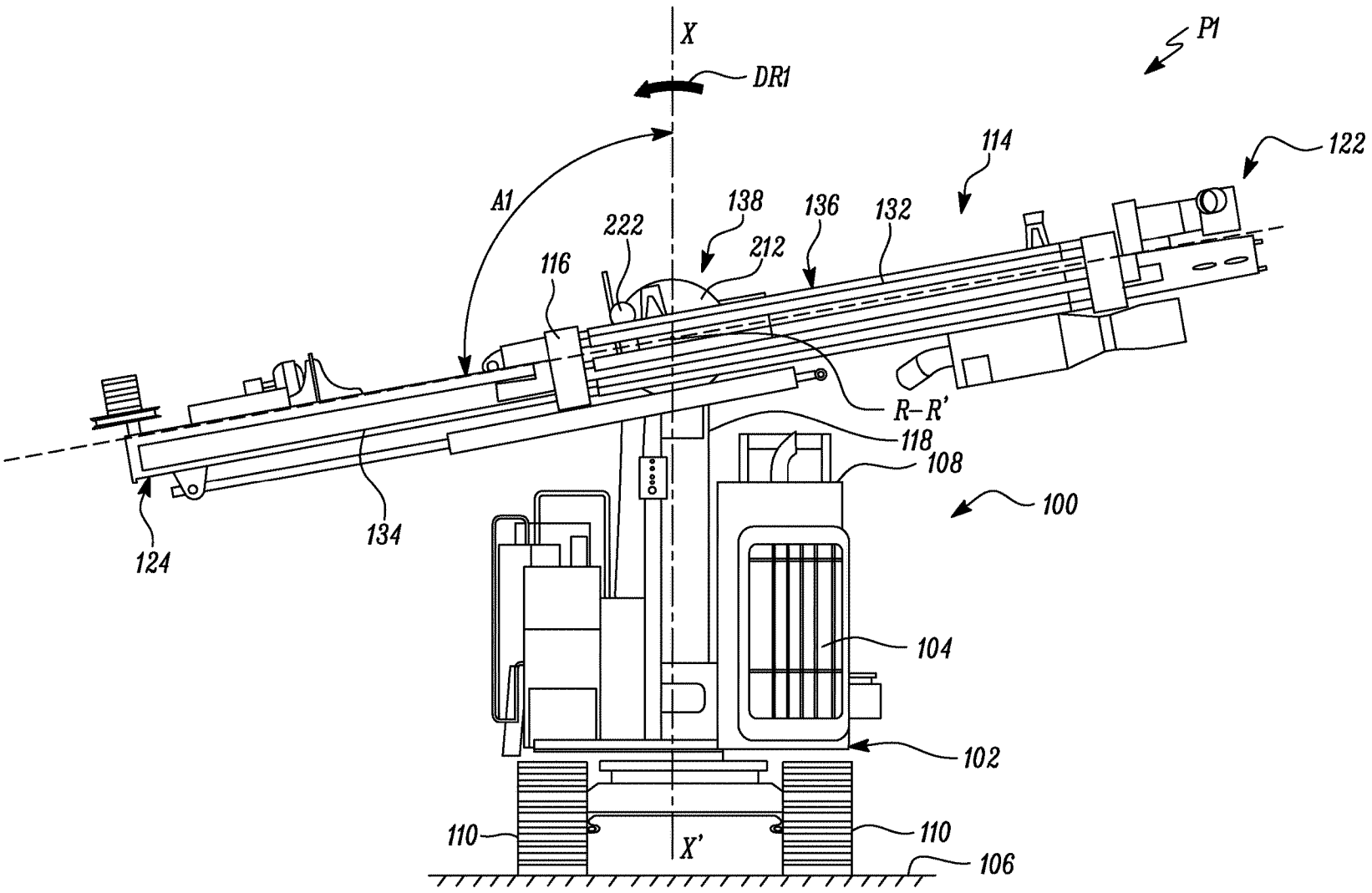
FIG. 6 is another front view of the machine showing another operating position of the swivel assembly, according to one embodiment of the present disclosure.

Referring to FIG. 5, the feed assembly 114 is shown in a vertical position "PV", such that the table 116 is aligned along the vertical axis X-X'. Referring to FIG. 6, based on the actuation of each of the first actuator 222 and the second actuator 224 in a direction "DR1", the table 116 and the feed assembly 114 is adapted to rotate about the rotational axis R-R' in a first position "P1" in the direction "DR1" relative to the vertical axis X-X'. As such, in the first position "P1", the table 116 defines an angle "A1" relative to the vertical axis X-X'. In the illustrated embodiment, the angle "A1" measure approximately 110 degrees (°). In other embodiments, an actual value of the angle "A1" may vary and may extend above 110 degrees (°), based on application requirements.

Figure 7:
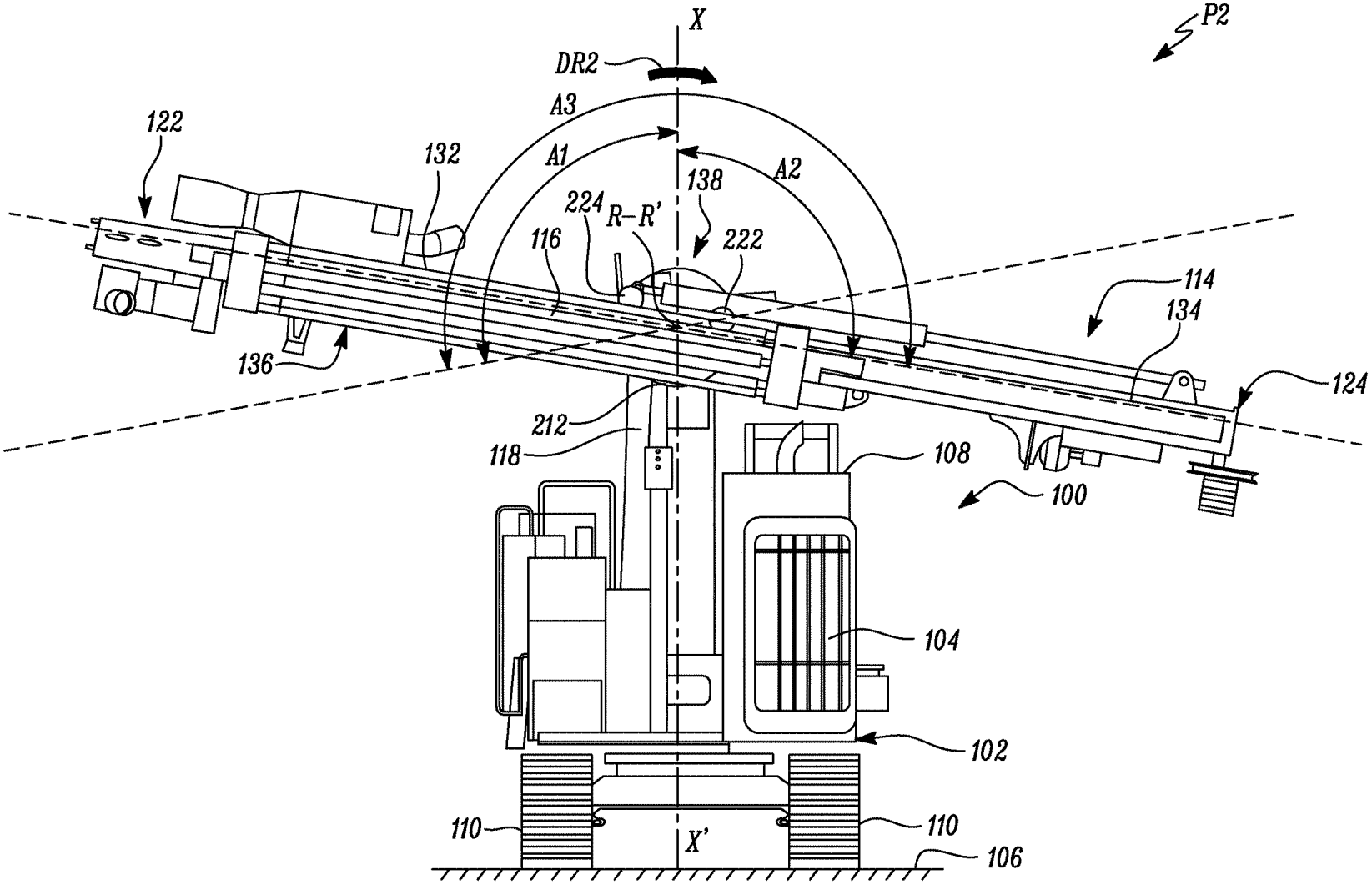
FIG. 7 is another front view of the machine showing yet another operating position of the swivel assembly, according to one embodiment of the present disclosure.

Referring to FIG. 7, based on the actuation of each of the first actuator 222 and the second actuator 224 in a direction "DR2", the table 116 and the feed assembly 114 is adapted to rotate about the rotational axis R-R' in a second position "P2" in the direction "DR2" relative to the vertical axis X-X'. As such, in the second position "P2", the table 116 defines an angle "A2" relative to the vertical axis X-X'. In the illustrated embodiment, the angle "A2" measures approximately 110°. In other embodiments, an actual value of the angle "A2" may vary and may extend above 110 degrees (°), based on application requirements. Accordingly, a range of rotation of the table 116 relative to the vertical axis X-X' about the rotational axis R-R' is defined by an angle "A3". The angle "A3" is a sum of the angle "A1" and the angle "A2". In the illustrated embodiment, the angle "A3" measures approximately 220°. In other embodiments, an actual value of the angle "A3" may vary and may be up to 360°, based on the actual values of the angle "A1" and the angle "A2".

INDUSTRIAL APPLICABILITY

The present disclosure relates to the swivel assembly 138 for the feed table 116 of the machine 100. In the illustrated embodiment, the swivel assembly 138 includes the range of rotation of approximately 220° as defined by the angle "A3". However, in practice, the swivel assembly 138 may provide the range of rotation of approximately 360°. The swivel joint 230 provided in association with each of the table 116 and the positioner 140 provides a simple and convenient interface to couple the hydraulic systems disposed on the feed assembly 114 with the hydraulic power source. More specifically, one or more hydraulic hoses (not shown) from the hydraulic power source may be coupled to the first portion 232 of the swivel joint 230. Further, the hydraulic systems provided on the feed assembly 114 may be coupled to the second portion 234 of the swivel joint 230. The swivel joint 230 provides fluid flow between the first portion 232 and the second portion 234 during rotation of the bearing 142, thus, limiting entangling of the hydraulic hoses. As such, the swivel joint 230 may limit interference of the hydraulic hoses with the feed assembly 114 during rotation of the table 116, thus, providing an improved range of rotation of the feed assembly 114.

The swivel assembly 138 includes the diameter "D1" of the first ring 206 and the diameter "D2" of the second ring 208 substantially greater than a width "W" (see FIG. 2) of the table 116. As such, the swivel assembly 138 provides an increased torque for rotation of the table 116 while employing relatively low powered first actuator 222 and/or the second actuator 224, in turn, reducing power requirement, reducing cost, and improving efficiency. The swivel assembly 138 includes components such as the table 116, the positioner 140, the bearing 142, the first actuator 222, the second actuator 224, the swivel joint 230, and so on. Such components may be readily available or may be easily manufactured, in turn, reducing complexity and costs. The swivel assembly 138 includes limited components, in turn, reducing weight, complexity, and costs.

As such, the swivel assembly 138 is substantially light in weight relative to a conventional linkage mechanism (not shown), in turn, improving agility of movement of the table 116. Also, rotation of the table 116 along the bearing 142 about the rotational axis R-R' provides an improved operability and usability of the feed assembly 114 and the drill assembly 122. Additionally, the bearing 142 provides a precise and symmetrical rotation and uniform rotational speed of the table 116 relative to the positioner 140 about the rotational axis R-R', in turn, improving positioning of the drill assembly 122. The swivel assembly 138 may be retrofitted on any drilling machine with little modification to existing system, in turn, improving compatibility and flexibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A swivel assembly for a drilling machine, the swivel assembly comprising:

a positioning member pivotally coupled to a boom member associated with the drilling machine;

a bearing assembly directly coupled to the positioning member and directly coupled to a feed table associated with the drilling machine, the bearing assembly adapted to rotate about a rotational axis; and at least one actuator operably coupled to the bearing assembly, wherein the bearing assembly is adapted to selectively rotate the feed table relative to the positioning member about the rotational axis based, at least in part, on an actuation of the at least one actuator.

2. The swivel assembly of claim 1, wherein the at least one actuator includes a plurality of actuators.

3. The swivel assembly of claim 1, wherein the at least one actuator is a hydraulic motor.

4. The swivel assembly of claim 1, wherein the bearing assembly includes:

a first ring member fixedly coupled to the positioning member;

a second ring member rotatably coupled with the first ring member and fixedly coupled to the feed table; and at least one bearing element disposed between the first ring member and the second ring member.

5. The swivel assembly of claim 4 further comprising:

a ring gear disposed within the first ring member, the ring gear adapted to be operably coupled to the at least one actuator.

6. The swivel assembly of claim 1 further comprising:

a swivel joint coupled to each of the positioning member and the feed table.

7. The swivel assembly of claim 1, wherein a range of rotation of the feed table about the rotational axis is up to 360 degrees (°).

8. A feed assembly for a drilling machine, the feed assembly comprising:

a feed table adapted to receive a drill assembly;

a positioning member pivotally coupled to a boom member associated with the drilling machine;

a bearing assembly directly coupled to the positioning member and directly coupled to the feed table, the bearing assembly adapted to rotate about a rotational axis; and at least one actuator operably coupled to the bearing assembly, wherein the bearing assembly is adapted to selectively rotate the feed table relative to the positioning member about the rotational axis based, at least in part, on an actuation of the at least one actuator.

9. The feed assembly of claim 8, wherein the at least one actuator includes a plurality of actuators.

10. The feed assembly of claim 8, wherein the at least one actuator is a hydraulic motor.

11. The feed assembly of claim 8, wherein the bearing assembly includes:

a first ring member fixedly coupled to the positioning member;

a second ring member rotatably coupled with the first ring member and fixedly coupled to the feed table; and at least one bearing element disposed between the first ring member and the second ring member.

12. The feed assembly of claim 11 further comprising:

a ring gear disposed within the first ring member, the ring gear adapted to be operably coupled to the at least one actuator.

13. The feed assembly of claim 8 further comprising:

a swivel joint coupled to each of the positioning member and the feed table.

14. The feed assembly of claim 8, wherein a range of rotation of the feed table about the rotational axis is up to 360 degrees (°).

15. A drilling machine comprising:

a chassis;

a boom member movably coupled to the chassis;

a positioning member pivotally coupled to the boom member;

a feed table rotatably coupled to the positioning member;

a bearing assembly directly coupled to the positioning member and directly coupled to the feed table, the bearing assembly adapted to rotate about a rotational axis; and at least one actuator operably coupled to the bearing assembly, wherein the bearing assembly is adapted to selectively rotate the feed table relative to the positioning member about the rotational axis based, at least in part, on an actuation of the at least one actuator.

16. The drilling machine of claim 15, wherein the at least one actuator is a hydraulic motor.

17. The drilling machine of claim 15, wherein the bearing assembly includes:

a first ring member fixedly coupled to the positioning member;

a second ring member rotatably coupled with the first ring member and fixedly coupled to the feed table; and at least one bearing element disposed between the first ring member and the second ring member.

18. The drilling machine of claim 17 further comprising:

a ring gear disposed within the first ring member, the ring gear adapted to be operably coupled to the at least one actuator.

19. The drilling machine of claim 15 further comprising:

a swivel joint coupled to each of the positioning member and the feed table.

20. The drilling machine of claim 15, wherein a range of rotation of the feed table about the rotational axis is up to 360 degrees (°).

* * * * *